US011459971B2

(12) United States Patent
Maeda et al.

(10) Patent No.: US 11,459,971 B2
(45) Date of Patent: Oct. 4, 2022

(54) ABNORMALITY DIAGNOSIS SYSTEM FOR FUEL SUPPLY SYSTEM, DATA TRANSMITTING DEVICE, AND ABNORMALITY DIAGNOSIS DEVICE

(71) Applicant: TOYOTA JIDOSHA KABUSHIKI KAISHA, Aichi-ken (JP)

(72) Inventors: Toshio Maeda, Okazaki (JP); Natsuhiro Kato, Toyota (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/242,189

(22) Filed: Apr. 27, 2021

(65) Prior Publication Data

US 2021/0381459 A1 Dec. 9, 2021

(30) Foreign Application Priority Data

Jun. 9, 2020 (JP) ..... JP2020-100177

(51) Int. Cl.
*F02D 41/22* (2006.01)
*F02D 41/24* (2006.01)

(52) U.S. Cl.
CPC ..... *F02D 41/22* (2013.01); *F02D 41/2451* (2013.01); *F02D 41/2477* (2013.01); *F02D 2041/224* (2013.01); *F02D 2200/0602* (2013.01); *F02D 2200/0606* (2013.01)

(58) Field of Classification Search
CPC ..... F02D 2041/224; F02D 2200/0602; F02D 2200/0606; F02D 41/22; F02D 41/2451; F02D 41/2477
See application file for complete search history.

(56) References Cited

FOREIGN PATENT DOCUMENTS

JP 2019143527 A 8/2019
KR 102212567 B1 * 2/2021

OTHER PUBLICATIONS

Machine Translation of KR102212567B1_Machine_Translation PDF File Name: "KR102212567B1_Machine_Translation.pdf".*

* cited by examiner

*Primary Examiner* — Grant Moubry
*Assistant Examiner* — Ruben Picon-Feliciano
(74) *Attorney, Agent, or Firm* — Hauptman Ham, LLP

(57) ABSTRACT

An abnormality diagnosis system is applied to a fuel supply system including a fuel pump that pumps fuel from a fuel tank and a fuel pipe in which fuel discharged from the fuel pump flows. The abnormality diagnosis system stores a minimum fuel pressure in the fuel pipe in one trip after a main switch of the fuel supply system is turned on and until the main switch is turned off and data indicating a state when the minimum fuel pressure was recorded as diagnosis data in a storage device. In the abnormality diagnosis system, an execution device determines a failure spot associated with a decrease in fuel pressure in the fuel pipe using the diagnosis data stored in the storage device and diagnoses an abnormality of the fuel supply system.

10 Claims, 6 Drawing Sheets

| | | FUEL TEMPERATURE [°C] | | | |
|---|---|---|---|---|---|
| | | temp1 | temp2 | temp3 | temp4 |
| MINIMUM FUEL PRESSURE [kPa] | 300~ | temp1d | temp2d | temp3d | temp4d |
| | 200~299 | temp1c | temp2c | temp3c | temp4c |
| | 100~199 | temp1b | temp2b | temp3b | temp4b |
| | 0~99 | temp1a | temp2a | temp3a | temp4a |

| | | ELAPSED TIME [s] | | | |
|---|---|---|---|---|---|
| | | time1 | time2 | time3 | time4 |
| MINIMUM FUEL PRESSURE [kPa] | 300~ | time1d | time2d | time3d | time4d |
| | 200~299 | time1c | time2c | time3c | time4c |
| | 100~199 | time1b | time2b | time3b | time4b |
| | 0~99 | time1a | time2a | time3a | time4a |

ABNORMALITY DIAGNOSIS SYSTEM FOR FUEL SUPPLY SYSTEM, DATA TRANSMITTING DEVICE, AND ABNORMALITY DIAGNOSIS DEVICE

CROSS-REFERENCE TO RELATED APPLICATION

This application claims priority to Japanese Patent Application No. 2020-100177 filed on Jun. 9, 2020, incorporated herein by reference in its entirety.

BACKGROUND

1. Technical Field

The present disclosure relates to an abnormality diagnosis system for a fuel supply system, a data transmitting device, and an abnormality diagnosis device.

2. Description of Related Art

A fuel supply system described in Japanese Unexamined Patent Application Publication No. 2019-143527 (JP 2019-143527 A) calculates a feedback correction value which is set based on a difference between a target fuel pressure and a detected fuel pressure in a state in which a pump voltage, a pump current, and a discharge flow rate from a fuel pump are set in a predetermined state. In the fuel supply system, the calculated feedback correction value is integrated and it is determined that the fuel pump is in a deteriorated state when the integrated value of the feedback correction value is equal to or greater than a threshold value.

SUMMARY

In the fuel supply system, it is determined that deterioration of the fuel pump is further progressing as the integrated value of the correction value of feedback control of the fuel pressure in a specific operating state increases. Accordingly, a decrease in fuel pressure due to a phenomenon which is likely to occur only under specific conditions or the like may be diagnosed as deterioration of the fuel pump. When a state in which the detected fuel pressure is lower than the target fuel pressure continues, the fuel pump is diagnosed as substantially deteriorating even if a cause thereof is not the deterioration of the fuel pump.

Configurations for solving the aforementioned problems and operations and advantages thereof will be described below.

According to an aspect of the present disclosure, there is provided an abnormality diagnosis system for a fuel supply system, the abnormality diagnosis system being applied to a fuel supply system including a fuel pump that pumps fuel from a fuel tank and a fuel pipe in which fuel discharged from the fuel pump flows. The abnormality diagnosis system includes a storage device and an execution device, and stores a minimum fuel pressure in the fuel pipe in one trip after a main switch of the fuel supply system is turned on and until the main switch is turned off and data indicating a state when the minimum fuel pressure was recorded as diagnosis data in the storage device. The execution device determines a failure spot associated with a decrease in fuel pressure in the fuel pipe using the diagnosis data and diagnoses an abnormality of the fuel supply system.

When a fuel pressure in the fuel pipe decreases while the fuel pump is operating, there is a likelihood of an abnormality occurring in the fuel supply system. With the aforementioned configuration, diagnosis of an abnormality is performed based on the minimum fuel pressure and data indicating the state when the minimum fuel pressure was recorded instead of diagnosing whether an abnormality has occurred under specific conditions. Accordingly, it is possible to detect various abnormalities due to other causes.

The data indicating a state when the minimum fuel pressure was recorded is data indicating a state when an abnormality is estimated to have occurred. Accordingly, it is possible to estimate why the fuel pressure in the fuel pipe has become the minimum fuel pressure using the diagnosis data including the data indicating a state when the minimum fuel pressure was recorded.

Accordingly, with the configuration of diagnosing an abnormality of the fuel supply system using the diagnosis data, it is possible to diagnose whether an abnormality has occurred and to determine a failure spot associated with a decrease in fuel pressure in the fuel pipe.

In the abnormality diagnosis system for a fuel supply system according to the aspect, the diagnosis data may include an elapsed time from starting of the fuel pump as the data indicating the state when the minimum fuel pressure was recorded.

The elapsed time from starting of the fuel pump to recording of the minimum fuel pressure is data indicating a relationship between a time at which the fuel pump was started and a time at which the decrease in fuel pressure was recorded. With the aforementioned configuration, it is possible to determine a failure spot associated with a decrease in fuel pressure in the fuel pipe with reference to whether the decrease in fuel pressure occurred immediately after the fuel pump was started or whether the decrease in fuel pressure occurred with a time elapsed from starting of the fuel pump.

In the abnormality diagnosis system for a fuel supply system according to the aspect, the execution device may determine deterioration of an impeller of the fuel pump and an operation failure of a check valve, which is provided in the fuel pipe and which is opened by a flow of fuel discharged from the fuel pump and is closed when the fuel pump stops and supply of fuel stops, as a cause of an abnormality associated with the decrease in fuel pressure in the fuel pipe, and diagnose an abnormality of the fuel supply system.

The check valve is opened when the fuel pump is operating, fuel is discharged from the fuel pump, and a flow of fuel from the fuel pump to a fuel injection valve is generated in the fuel pipe. When the check valve is not appropriately opened due to an operation failure of the check valve, a decrease in fuel pressure is likely to occur immediately after the fuel pump has been started. On the other hand, when the impeller of the fuel pump has deteriorated, the impeller of the fuel pump is deformed while the fuel pump is operating, and the impeller is not likely to rotate well due to interference with a housing. As a result, a decrease in fuel pressure occurs. Such a decrease in fuel pressure due to deterioration of the impeller is likely to occur in a time period after a time period in which a decrease in fuel pressure due to an operation failure of the check valve is likely to occur.

Accordingly, when the minimum fuel pressure has been recorded after a relatively long time elapsed from starting of the fuel pump, the deterioration of the impeller is more likely to be a cause of the decrease in fuel pressure rather than the operation failure of the check valve.

Accordingly, when data indicating a relationship between the time at which the fuel pump was started and the time at which a decrease in fuel pressure occurred is used as the diagnosis data like the aforementioned configuration, it is possible to determine the deterioration of the impeller of the fuel pump and the operation failure of the check valve and to diagnose an abnormality of the fuel supply system.

In the abnormality diagnosis system for a fuel supply system according to the aspect, the execution device may determine a cause of an abnormality associated with the decrease in fuel pressure in the fuel pipe using collection data which is acquired by counting an occurrence frequency of the minimum fuel pressure for each combination of areas into which various types of data included in the diagnosis data are classified based on magnitudes of values of the data, and diagnose an abnormality of the fuel supply system.

With this configuration, since diagnosis is performed using collection data obtained by collecting diagnosis data in a plurality of trips, it is possible to perform diagnosis with higher accuracy in comparison with a case in which diagnosis is performed using the diagnosis data in only one trip.

In the abnormality diagnosis system for a fuel supply system according to the aspect, the diagnosis data may include a fuel temperature as the data indicating the state when the minimum fuel pressure was recorded.

The fuel temperature when the minimum fuel pressure was recorded is data indicating a relationship between the fuel temperature and the decrease in fuel pressure. When an abnormality occurs in the fuel supply system and the fuel pressure decreases, a degree of influence of the fuel temperature on the decrease in fuel pressure varies depending on a spot in which a failure occurs. With the aforementioned configuration, it is possible to determine a failure spot associated with the decrease in fuel pressure in the fuel pipe with reference to whether the decrease in fuel pressure occurs when the fuel temperature is low or when the fuel temperature is high.

In the abnormality diagnosis system for a fuel supply system according to the aspect, the execution device may determine deterioration of an impeller of the fuel pump, an operation failure of a check valve, which is provided in the fuel pipe and which is opened by a flow of fuel discharged from the fuel pump and is closed when the fuel pump stops and supply of fuel stops, and other abnormalities which are not affected by the fuel temperature as a cause of an abnormality associated with the decrease in fuel pressure in the fuel pipe, and diagnose an abnormality of the fuel supply system.

When the impeller has deteriorated, the impeller is likely to be deformed with an increase in the fuel temperature and the temperature of the impeller and the fuel pressure is likely to decrease due to interference of the impeller with the housing. The check valve is more likely to cause an operation failure as the fuel temperature decreases. Accordingly, by performing diagnosis using the collection data obtained by collecting the diagnosis data including data of the fuel temperature when the minimum fuel pressure was recorded as in the aforementioned configuration, it is possible to diagnose whether a decrease in fuel pressure is an abnormality due to deterioration of the impeller or the operation failure of the check valve which is affected by the fuel temperature or another abnormality which is not affected by the fuel temperature.

Examples of the other abnormality which is not affected by the fuel temperature include breakage of the fuel pipe.

In the abnormality diagnosis system for a fuel supply system according to the aspect, the storage device may store a trained model which is trained by machine learning using training data in which information indicating whether an abnormality associated with the decrease in fuel pressure in the fuel pipe has occurred and a type of a cause of the abnormality is given as a correction answer label to the collection data, and the execution device may determine a cause of an abnormality associated with the decrease in fuel pressure in the fuel pipe using the trained model with the collection data as an input and diagnose an abnormality of the fuel supply system.

A model that diagnoses whether an abnormality has occurred based on the collection data and outputs a type of a cause of an abnormality when the abnormality has occurred can be prepared by machine learning.

By using machine learning, there is a likelihood that a feature of which a person is not likely to be aware will be extracted and be used for diagnosis of an abnormality. As in the aforementioned configuration, in comparison with a case in which a trained model with a plurality of pieces of diagnosis data as an input is constructed, it is possible to decrease an amount of input data using a trained model with the collection data of the diagnosis data as an input.

In the abnormality diagnosis system for a fuel supply system according to the aspect, the trained model may be a decision tree.

In comparison with a model such as a neural network, a person can more easily understand grounds for diagnosis using the trained model using the decision tree. With the aforementioned configuration, it is possible to construct an abnormality diagnosis system that can easily explain grounds for a result of diagnosis.

In the abnormality diagnosis system for a fuel supply system according to the aspect, the storage device may include a first storage device that is mounted in a vehicle and stores the diagnosis data and a second storage device that is mounted in a device other than the vehicle and stores the trained model. The execution device may be mounted in the device other than the vehicle along with the second storage device, receive the diagnosis data stored in the first storage device from the vehicle, prepare the collection data, determine a cause of an abnormality associated with the decrease in fuel pressure in the fuel pipe using the trained model stored in the second storage device with the prepared collection data as an input, and diagnose an abnormality of the fuel supply system.

With this configuration, preparation of the collection data, diagnosis of an abnormality using the trained model, and the like are performed by a device other than the vehicle. Accordingly, it is possible to curb an increase in capacity of a vehicle-side storage device or an increase in a calculational load on a vehicle side.

A data transmitting device that is mounted in a vehicle and includes a first storage device and a transmitter transmitting the diagnosis data or an abnormality diagnosis device that is mounted in a device other than a vehicle and includes an execution device, a second storage device, and a receiver receiving the diagnosis data is conceivable as a constituent of the abnormality diagnosis system with the aforementioned configurations.

BRIEF DESCRIPTION OF THE DRAWINGS

Features, advantages, and technical and industrial significance of exemplary embodiments of the present disclosure will be described below with reference to the accompanying drawings, in which like sings denote like elements, and wherein.

DETAILED DESCRIPTION OF EMBODIMENTS

Hereinafter, an abnormality diagnosis system for a fuel supply system according to an embodiment will be described with reference to FIGS. 1 to 8.

Figure 1:
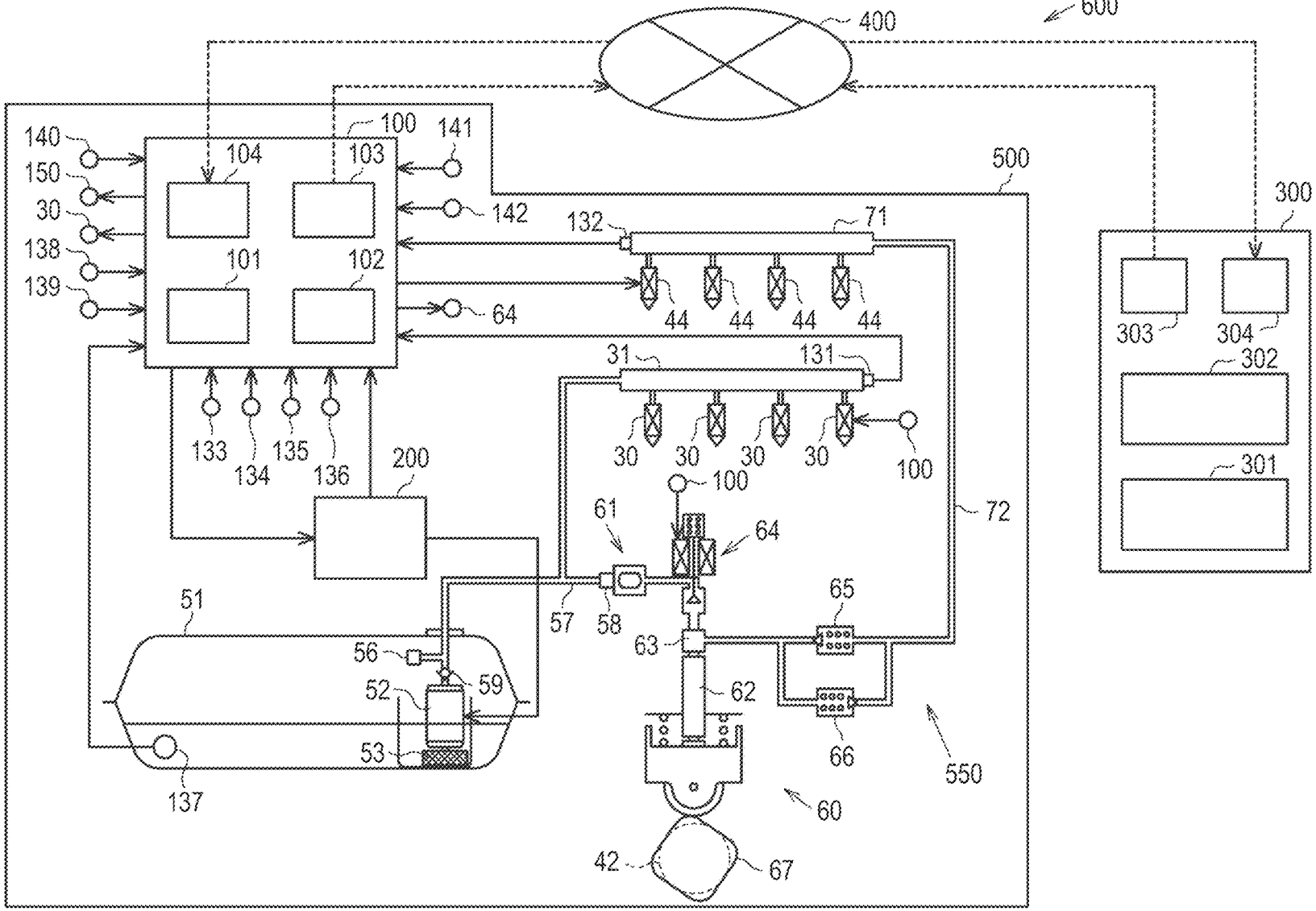
FIG. 1 is a diagram schematically illustrating a relationship between an abnormality diagnosis system according to an embodiment and a fuel supply system which is diagnosed by the abnormality diagnosis system.

FIG. 1 illustrates configurations of an abnormality diagnosis system according to this embodiment and a fuel supply system to which the abnormality diagnosis system is applied.

The abnormality diagnosis system 600 according to this embodiment is applied to a fuel supply system 550 of an onboard engine which is mounted in a vehicle 500.

As illustrated in FIG. 1, two fuel pumps including a fuel pump 52 that is installed inside a fuel tank 51 and a high-pressure fuel pump 60 that is installed outside the fuel tank 51 are provided in the fuel supply system 550 to which the abnormality diagnosis system 600 is applied. The fuel pump 52 is an electrical pump that rotates an impeller with a brushless motor. A cylinder fuel injection valve 44 and a port fuel injection valve 30 are provided in the fuel supply system 550. The cylinder fuel injection valve 44 is provided in each cylinder of an engine and injects fuel directly into each cylinder of the engine. The cylinder fuel injection valve 44 is connected to a high-pressure delivery pipe 71 that is a fuel accumulating container. The port fuel injection valve 30 injects fuel into an intake port connected to each cylinder of the engine. The port fuel injection valve 30 is connected to a low-pressure delivery pipe 31. The engine in which the fuel supply system 550 is mounted is an in-line four-cylinder engine, and four cylinder fuel injection valves 44 are connected to the high-pressure delivery pipe 71. Four port fuel injection valves 30 are also connected to the low-pressure delivery pipe 31.

A fuel pipe 57 that is a fuel passage for sending fuel from the fuel pump 52 to the high-pressure fuel pump 60 and the low-pressure delivery pipe 31 and a high-pressure fuel pipe 72 that is a fuel passage for sending fuel from the high-pressure fuel pump 60 to the high-pressure delivery pipe 71 are provided in the fuel supply system 550. The fuel pipe 57 branches in the middle thereof, one end thereof is connected to the high-pressure fuel pump 60, and the other end is connected to the low-pressure delivery pipe 31.

A fuel pressure sensor 131 that detects a pressure of fuel in the fuel pipe 57 and the low-pressure delivery pipe 31 is provided in the low-pressure delivery pipe 31. A fuel pressure sensor 132 that detects a pressure of fuel on a high pressure side which is a pressure of fuel accumulated in the high-pressure delivery pipe 71 is provided in the high-pressure delivery pipe 71. The fuel pressure sensors 131, 132 express a fuel pressure as a gauge pressure with respect to an atmospheric pressure.

The fuel pump 52 suctions fuel in the fuel tank 51 via an upstream filter 53 and sends the fuel to the fuel pipe 57 with supply of electric power. A relief valve 56 that is opened to relieve fuel from the fuel pipe 57 to the fuel tank 51 when a feed pressure Pf which is a pressure of fuel transmitted to the fuel pipe 57 by the fuel pump 52, that is, a fuel pressure in the fuel pipe 57, is greater than a predetermined valve opening pressure is provided in a part of the fuel pipe 57 located inside the fuel tank 51.

A check valve 59 that is provided with a fuel pump side as a lower side, sits on a valve seat below which a valve body is located with its weight, and is opened by a flow of fuel discharged from the fuel pump 52 is provided in a part of the fuel pipe 57 which is upstream from the part in which the relief valve 56 is provided. The check valve 59 is closed when the fuel pump 52 stops and supply of fuel stops.

The fuel pipe 57 is connected to the high-pressure fuel pump 60 via a downstream filter 58 that filters impurities in fuel flowing in the fuel pipe 57 and a pulsation damper 61 that decreases a pulsation in fuel pressure in the fuel pipe 57.

The high-pressure fuel pump 60 includes a plunger 62, a fuel chamber 63, an electromagnetic spill valve 64, a check valve 65, and a relief valve 66. The plunger 62 is driven to reciprocate by a pump cam 67 which is provided in a cam shaft 42 of an engine, and changes a volume of the fuel chamber 63 with the reciprocating movement thereof. The fuel chamber 63 is connected to the fuel pipe 57 via the electromagnetic spill valve 64

The electromagnetic spill valve 64 is closed with supply of electric power thereto to cut off a flow of fuel between the fuel chamber 63 and the fuel pipe 57 and is opened with stop of the supply of electric power to permit a flow of fuel between the fuel chamber 63 and the fuel pipe 57. The check valve 65 permits discharge of fuel from the fuel chamber 63 to the high-pressure delivery pipe 71, and prohibits a back flow of fuel from the high-pressure delivery pipe 71 to the fuel chamber 63. The relief valve 66 is provided in a passage bypassing the check valve 65, and is opened to permit a back flow of fuel to the fuel chamber 63 when the pressure on the high-pressure delivery pipe 71 side increases excessively.

A fuel pressurizing operation of the high-pressure fuel pump 60 having the aforementioned configuration will be described below. In the high-pressure fuel pump 60, the volume of the fuel chamber 63 changes with reciprocation of the plunger 62. In the following description, the operation of the plunger 62 in a direction in which the volume of the fuel chamber 63 increases is referred to as descent of the plunger 62, and the operation of the plunger 62 in a direction in which the volume of the fuel chamber 63 decreases is referred to as ascent of the plunger 62.

In the high-pressure fuel pump 60, when the descent of the plunger 62 is started in a state in which the electromagnetic spill valve 64 is open, fuel flows into the fuel chamber 63 from the fuel pipe 57 with the increase in volume of the fuel chamber 63. When the electromagnetic spill valve 64 is maintained in an open state even after the plunger 62 has changed from the descent to the ascent, fuel flowing into the fuel chamber 63 during the descent of the plunger 62 is returned to the fuel pipe 57. When the electromagnetic spill valve 64 is closed during the ascent of the plunger 62 and the closed state of the electromagnetic spill valve 64 is maintained until the plunger 62 changes from the ascent to the descent, fuel in the fuel chamber 63 is pressurized with the decrease in volume of the fuel chamber 63 due to the ascent of the plunger 62. When the fuel pressure in the fuel chamber 63 is greater than the fuel pressure in the high-pressure fuel pipe 72, the check valve 65 is opened and the pressurized fuel in the fuel chamber 63 is delivered to the high-pressure fuel pipe 72. In this way, the high-pressure fuel pump 60 pressurizes fuel in the fuel pipe 57 and delivers the pressurized fuel to the high-pressure fuel pipe 72 whenever the plunger 62 reciprocates. By changing the closing time of the electromagnetic spill valve 64 during the ascent of the plunger 62, an amount of fuel which is delivered to the high-pressure fuel pipe 72 by the high-pressure fuel pump 60 in each pressurizing operation is increased or decreased.

The engine including the fuel supply system 550 is controlled by a control device 100. The control device 100 is a control device for an engine and also controls the fuel supply system 550 of the engine. That is, the control device 100 also serves as a control device for the fuel supply system 550.

The control device 100 includes an execution device 101 that performs various operation processes and a storage device 102 that stores control programs or data. The control device 100 also includes a transmitter 103 that transmits data via a communication network 400 and a receiver 104 that receives data via the communication network 400.

The control device 100 performs control of the engine including control of the fuel supply system 550 by causing the execution device 101 to read and execute a program stored in the storage device 102.

Detection signals of various sensors that detect an operating state of the engine are input to the control device 100. As illustrated in FIG. 1, a detection signal of an accelerator operation amount by a driver which is detected by an accelerator position sensor 142 and a detection signal of a vehicle speed which is a travel speed of the vehicle detected by a vehicle speed sensor 141 are input to the control device 100.

Other detection signals of various other sensors are input to the control device 100. For example, as illustrated in FIG. 1, in addition to the fuel pressure sensors 131, 132, an air flowmeter 133, a crank position sensor 134, a cam position sensor 135, and a coolant temperature sensor 136 are connected to the control device 100.

The air flowmeter 133 detects a temperature of air taken into the cylinders via an intake passage of the engine and an amount of intake air which is a mass of intake air. The crank position sensor 134 outputs a crank angle signal based on change in a rotational phase of a crank shaft which is an output shaft of the engine. The control device 100 calculates an engine rotation speed which is a rotation speed of the crank shaft per unit time based on the crank angle signal which is input from the crank position sensor 134.

The cam position sensor 135 outputs a cam angle signal based on change in a rotational phase of the cam shaft 42. The coolant temperature sensor 136 detects a coolant temperature which is a temperature of a coolant of the engine.

A fuel temperature sensor 137 that detects a fuel temperature Tf which is a temperature of fuel in the fuel tank 51, a fuel level sensor 138 that detects a height level of a fuel surface in the fuel tank 51 and outputs a detection signal indicating a residual amount of fuel, and an outside air temperature 139 that detects an outside air temperature are also connected to the control device 100.

A main switch 140 of the vehicle and a display unit 150 are also connected to the control device 100. The display unit 150 displays an icon or a sentence for notifying an occupant of occurrence of an abnormality when the abnormality has occurred in the vehicle 500.

A fuel pump control device 200 that controls a pump rotation speed Np which is a rotation speed per unit time of the impeller of the fuel pump 52 is also connected to the control device 100. The fuel pump control device 200 increases or decreases the pump rotation speed Np by adjusting electric power supplied to the fuel pump 52 using pulse width modulation based on a command from the control device 100. The fuel pump control device 200 transmits information of a pump current Ip which is a current supplied to the fuel pump 52 and the pump rotation speed Np to the control device 100.

The control device 100 performs fuel injection control, fuel pressure variable control, and feed pressure control as parts of engine control.

At the time of fuel injection control, the control device 100 first calculates a required amount of injected fuel which is a required value of an amount of injected fuel of the cylinder fuel injection valve 44 and the port fuel injection valve 30 according to an engine operating state such as an engine rotation speed or a load factor of the engine. Subsequently, the control device 100 calculates an opening period of time of the cylinder fuel injection valve 44 and the port fuel injection valve 30 which are required for injection of fuel corresponding to the required amount of injected fuel. Then, the control device 100 operates the cylinder fuel injection valve 44 of each cylinder and the port fuel injection valve 30 to inject fuel in a period corresponding to the calculated opening period of time. The control device 100 also performs fuel-cut control for stopping injection of fuel to stop supply of fuel to a combustion chamber of the engine and achieving a decrease in fuel consumption rate during deceleration in which the accelerator operation amount is "0" or the like as a part of fuel injection control. The control device 100 stops the operation of the fuel pump 52 when injection of fuel is being stopped.

At the time of fuel pressure variable control, the control device 100 calculates a target value of a high-side fuel pressure based on the load factor of the engine and the like. The target value of the high-side fuel pressure is basically set to a low pressure when the load factor of the engine is low and a high pressure when the load factor of the engine is high. Then, the control device 100 adjusts an amount of delivered fuel of the high-pressure fuel pump 60 to decrease a difference between the detection value of the high-side fuel pressure from the fuel pressure sensor 132 and the target value of the high-side fuel pressure. Specifically, when the detection value of the high-side fuel pressure is lower than the target value, the closing time of the electromagnetic spill valve 64 in the ascent period of the plunger 62 is advanced to increase the amount of delivered fuel of the high-pressure fuel pump 60. When the detection value of the high-side fuel pressure is higher than the target value, the closing time of the electromagnetic spill valve 64 in the ascent period of the plunger 62 is delayed to decrease the amount of delivered fuel of the high-pressure fuel pump 60.

Details of a pressure adjusting process which is performed as a part of feed pressure control will be described below. The pressure adjusting process is performed for the following purposes. When fuel delivered from the fuel pump 52 and flowing in the fuel pipe 57 is heated by the engine and is increased in temperature, vapor may be generated in the fuel pipe 57 and supply of fuel to the high-pressure delivery pipe 71 or the low-pressure delivery pipe 31 may be delayed. Since a vaporization temperature of fuel increases as the fuel pressure increases, the amount of delivered fuel from the fuel pump 52 to the fuel pipe 57 may be increased to increase the feed pressure Pf in order to prevent generation of vapor in the fuel pipe 57. However, when the amount of delivered fuel is increased, power consumption in the fuel pump 52 is increased by as much. Therefore, in the pressure adjusting process, power consumption is curbed and generation of vapor is prevented by adjusting an amount of fuel discharged from the fuel pump 52 in order to keep the feed pressure Pf low as long as generation of vapor can be prevented.

Specifically, the execution device 101 of the control device 100 calculates a required feed pressure Pf* which is a target value of the feed pressure Pf based on the fuel temperature Tf detected by the fuel temperature sensor 137. The control device 100 changes the required feed pressure Pf* according to the fuel temperature Tf. The control device 100 increases the required feed pressure Pf* as the fuel temperature Tf increases such that the required feed pressure Pf* is not less than a saturated vapor pressure even when fuel with the highest saturated vapor pressure out of fuel which is assumed to be used is used. The execution device 101 calculates a required pump rotation speed Np* which is a target value of the pump rotation speed Np based on an amount of injected fuel Qf and the required feed pressure Pf*.

The amount of injected fuel Qf can be acquired based on the required amount of injected fuel calculated by the fuel injection control, that is, a sum of the required amount of injected fuel to the cylinder fuel injection valve 44 and the required amount of injected fuel to the port fuel injection valve 30.

In the control device 100, the execution device 101 calculates the pump rotation speed Np required for realizing the required feed pressure Pf* as the required pump rotation speed Np* in consideration of an amount of fuel consumed with execution of the fuel injection control. Specifically, the execution device 101 calculates the required pump rotation speed Np* with reference to an operation map which is stored in the storage device 102. This operation map is prepared to calculate the required pump rotation speed Np*, for example, based on results of experiment using gasoline as fuel. In the operation map, the required pump rotation speed Np* which is output increases as the required feed pressure Pf* increases and as the amount of injected fuel Qf increases.

The execution device 101 of the control device 100 calculates a correction value ΔN of the required pump rotation speed Np* based on the required feed pressure Pf* and the feed pressure Pf detected by the fuel pressure sensor 131. Specifically, when the feed pressure Pf is less than the required feed pressure Pf*, the execution device 101 increases the correction value ΔN by a predetermined value. On the other hand, when the feed pressure Pf is greater than the required feed pressure Pf*, the execution device 101 decreases the correction value ΔN by a predetermined value. Then, the execution device 101 corrects the required pump rotation speed Np* by adding the calculated correction value ΔN to the required pump rotation speed Np*. Accordingly, the required pump rotation speed Np* corrected using the correction value ΔN is input to the fuel pump control device 200. Then, the fuel pump control device 200 controls electric power supplied to the fuel pump 52 such that the input required pump rotation speed Np* is realized.

When the required pump rotation speed Np* increases, an amount of fuel discharged from the fuel pump 52 per unit time increases and thus the feed pressure Pf increases. On the other hand, when the required pump rotation speed Np* decreases, the amount of fuel discharged from the fuel pump 52 per unit time decreases and thus the feed pressure Pf decreases.

In this way, the feed pressure Pf is controlled in a feedback manner in the fuel supply system 550. The execution device 101 of the control device 100 controls electric power supplied to the fuel pump 52 such that the required feed pressure Pf* is realized through the pressure adjusting process.

When an abnormality occurs in the fuel supply system 550, the required feed pressure Pf* cannot be realized. Accordingly, the abnormality diagnosis system 600 collects information of the fuel supply system 550 and diagnoses an abnormality of the fuel supply system 550 using the server device 300 connected to the control device 100 via the communication network 400.

As illustrated in FIG. 1, the server device 300 includes an execution device 301 and a storage device 302 that stores control programs or data. The server device 300 also includes a transmitter 303 that transmits data to the receiver 104 of the control device 100 via the communication network 400 and a receiver 304 that receives data transmitted from the transmitter 103 of the control device 100 via the communication network 400.

When an abnormality occurs in the fuel supply system 550, the feed pressure Pf decreases and the feed pressure Pf may be less than the required feed pressure Pf*. In the abnormality diagnosis system 600, a failure spot in which a decrease of the feed pressure Pf occurs is determined out of three predetermined classifications and an abnormality of the fuel supply system 550 is diagnosed.

Specifically, in the abnormality diagnosis system 600, the execution device 301 of the server device 300 diagnoses whether an abnormality has occurred in the fuel supply system 550. When it is diagnosed that an abnormality has occurred, the execution device 301 determines which of deterioration of the impeller of the fuel pump 52, an operation failure of the check valve 59, and other abnormality which is not affected by the fuel temperature Tf is a cause of the abnormality and diagnoses that the abnormality has occurred.

Figures 2, 3:
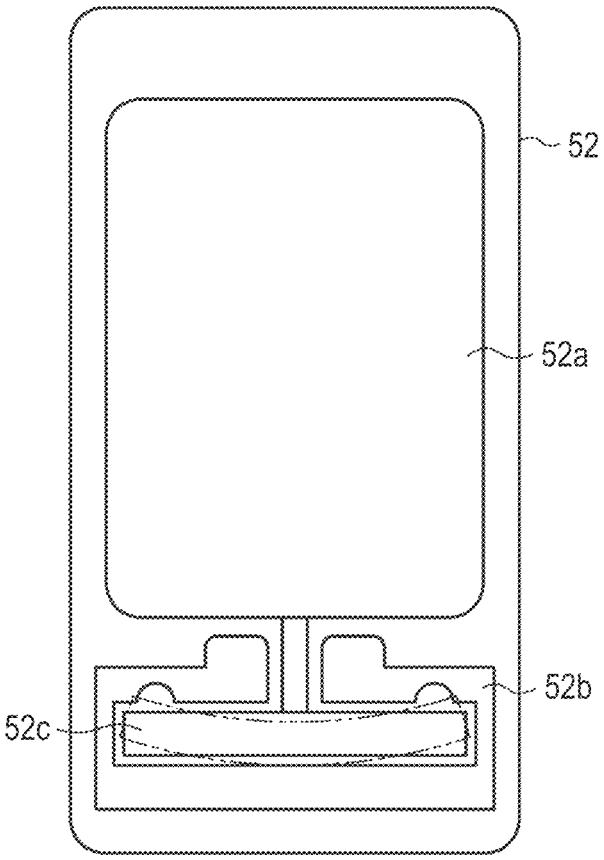
FIG. 2 is a diagram schematically illustrating a change of state of an impeller in a fuel pump.
FIG. 3 is a table illustrating collection data which is acquired by collecting an occurrence frequency of a minimum fuel pressure according to a combination of the minimum fuel pressure and a fuel temperature.

As illustrated in FIG. 2, the fuel pump 52 pumps fuel by driving an impeller 52*c* accommodated in a housing 52*b* using a brushless motor 52*a*. The impeller 52*c* is formed of a resin and is deformed with an increase in temperature when it deteriorates with impregnation of fuel thereinto. As indicated by a two-dot chain line in FIG. 2, when the impeller 52*c* is deformed and is bent, the impeller 52*c* is less likely to rotate due to interference with the housing 52*b*. As a result, the decrease of the feed pressure Pf is caused. That is, the decrease of the feed pressure Pf due to such deterioration of the impeller 52*c* is more likely to occur when the fuel temperature Tf is high.

As illustrated in FIG. 1, the check valve 59 is disposed downstream from the fuel pump 52. When the check valve 59 is not appropriately opened due to an operation failure of the check valve 59, the decrease of the feed pressure Pf also occurs. Such an operation failure of the check valve 59 is likely to occur when the fuel temperature Tf is low or immediately after the fuel pump 52 starts operating.

In this way, the decrease of the feed pressure Pf due to the deterioration of the impeller 52*c* or the decrease of the feed pressure Pf due to the operation failure of the check valve 59 is affected by the fuel temperature Tf. On the other hand, there is also an abnormality of which trends of an occurrence frequency do not change depending on whether the fuel temperature Tf is high or low and which is not affected by the fuel temperature Tf. In the abnormality diagnosis system 600, the execution device 301 collects the occurrence frequency of the decrease in fuel pressure in the fuel supply system 550 and classifies an abnormality which is not affected by the fuel temperature Tf as other abnormality. The other abnormality which is not affected by the fuel temperature Tf includes, for example, breakage of the fuel pipe 57.

In the abnormality diagnosis system 600, specifically, the control device 100 mounted in a vehicle 500 monitors the feed pressure Pf in one trip after the main switch 140 has been turned on and until it is turned off, and stores a minimum fuel pressure in the one trip and data indicating a state when the minimum fuel pressure was recorded as diagnosis data in the storage device 102.

The control device 100 stores the fuel temperature Tf when the minimum fuel pressure has been recorded and an elapsed time after the fuel pump 52 was started and until the minimum fuel pressure was recorded in the trip in addition to the value of the minimum fuel pressure as the data indicating the state when the minimum fuel pressure was recorded in the trip in the storage device 102. In the abnormality diagnosis system 600, when the main switch 140 is turned off and one trip ends, the control device 100 transmits the diagnosis data to the server device 300 via the transmitter 103.

The server device 300 receives the diagnosis data transmitted from the control device 100 using the receiver 304. The server device 300 stores the received diagnosis data in the storage device 302, collects the diagnosis data, and prepares collection data which is used for the diagnosis process. That is, in the server device 300, the execution device 301 updates the collection data stored in the storage device 302 whenever the diagnosis data is received by the receiver 304. The preparation of collection data is performed for each vehicle 500, that is, for each fuel supply system 550. The diagnosis process is performed individually for the fuel supply system 550 of each vehicle 500 using the collection data which is prepared for each vehicle 500.

Figures 4, 5:
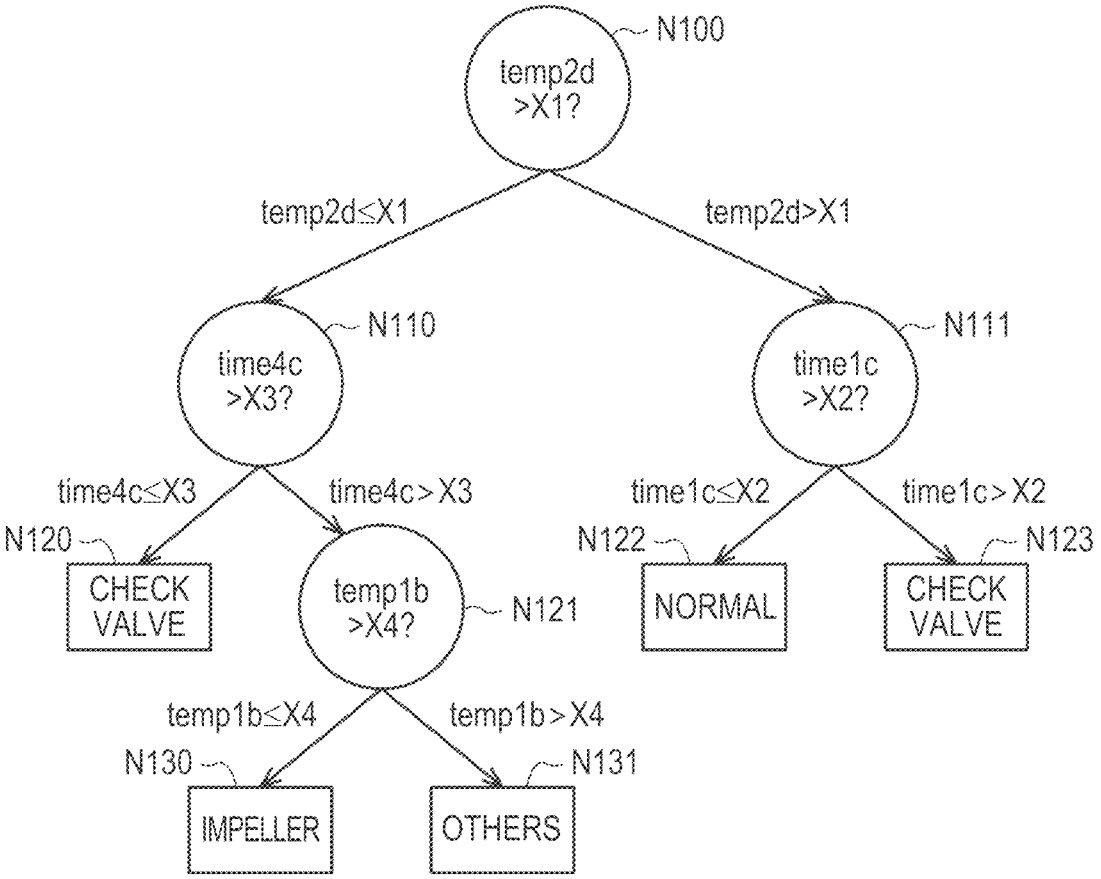
FIG. 4 is a table illustrating collection data which is acquired by collecting an occurrence frequency of the minimum fuel pressure according to a combination of the minimum fuel pressure and an elapsed time after a fuel pump has started.
FIG. 5 is a diagram illustrating a decision tree which is used for a diagnosis process.

The abnormality diagnosis system 600 prepares first collection data which is obtained by collecting the frequency in which the minimum fuel pressure was recorded according to a combination of the minimum fuel pressure and the fuel temperature Tf as illustrated in FIG. 3 and second collection data which is obtained by collecting the frequency in which the minimum fuel pressure was recorded according to a combination of the minimum fuel pressure and the elapsed time after the fuel pump 52 was started as illustrated in FIG. 4.

As illustrated in FIG. 3, in the abnormality diagnosis system 600, the minimum fuel pressure is classified into four areas of "0 kPa to 99 kPa," "100 kPa to 199 kPa," "200 kPa to 299 kPa," and "300 kPa and greater" depending on the magnitude of the minimum fuel pressure in the first collection data. As illustrated in FIG. 3, in the abnormality diagnosis system 600, the fuel temperature Tf is classified into four areas of a "first temperature area temp1," a "second temperature area temp2," a "third temperature area temp3," and a "fourth temperature area temp4" depending on the magnitude of the fuel temperature Tf in the first collection data. The "first temperature area temp1" is a temperature area corresponding to a case in which the fuel temperature Tf when the minimum fuel pressure has been recorded is, for example, lower than 30° C. The "second temperature area temp2" is a temperature area corresponding to a case in which the fuel temperature Tf when the minimum fuel pressure has been recorded is, for example, equal to or higher than 30° C. and lower than 40° C. The "third temperature area temp3" is a temperature area corresponding to a case in which the fuel temperature Tf when the minimum fuel pressure has been recorded is, for example, equal to or higher than 40° C. and lower than 50° C. The "fourth temperature area temp4" is a temperature area corresponding to a case in which the fuel temperature Tf when the minimum fuel pressure has been recorded is, for example, equal to or higher than 50° C.

As illustrated in FIG. 3, in the first collection data corresponding to combinations of the minimum fuel pressure and the fuel temperature Tf, the frequency in which the minimum fuel pressure was recorded is collected in a total of 16 areas obtained by multiplying four areas based on the magnitude of the minimum fuel pressure by four areas based on the magnitude of the fuel temperature Tf.

For example, the abnormality diagnosis system 600 increments the frequency in the area "temp3d" by "1" and updates the collection data when the minimum fuel pressure in diagnosis data newly received by the server device 300 is equal to or greater than 300 kPa and the fuel temperature Tf when the minimum fuel pressure has been recorded is 45° C.

As illustrated in FIG. 4, the abnormality diagnosis system 600 classifies the elapsed time after the fuel pump 52 was started in each trip into four areas of a "first time area time1," a "second area time2," a "third time area time3," and a "fourth time area time4" depending on the magnitude of the elapsed time in the second collection data. The "first time area time1" is a time area corresponding to a case in which the elapsed time when the minimum fuel pressure was recorded is, for example, less than 10 seconds. The "second time area time2" and the time areas subsequent thereto are time areas in which the ranges of the corresponding elapsed time are greater, for example, by several tens of seconds. That is, the "second time area time2" is a time area corresponding to a case in which the elapsed time when the minimum fuel pressure was recorded is, for example, equal to or greater than 10 seconds and less than several tens of seconds, and the "third time area time3" is a time area corresponding to a case in which the elapsed time corresponds to a range of several tens of seconds after the "second time area time2." The "fourth time area time4" is a time area corresponding to a case in which the elapsed time when the minimum fuel pressure was recorded is, for example, greater than the elapsed time corresponding to the "third time area time3."

As illustrated in FIG. 4, in the second collection data corresponding to combinations of the minimum fuel pressure and the elapsed time, the frequency in which the minimum fuel pressure was recorded is collected in a total of 16 areas obtained by multiplying four areas based on the magnitude of the minimum fuel pressure by four areas based on the magnitude of the elapsed time.

For example, the abnormality diagnosis system 600 increments the frequency in the area "time2c" by "1" and updates the collection data when the minimum fuel pressure in diagnosis data newly received by the server device 300 is 250 kPa and the elapsed time when the minimum fuel pressure was recorded is 15 seconds.

When the diagnosis data for the fuel supply system 550 which is a diagnosis target is received a predetermined number of times, the server device 300 performs a diagnosis process on the fuel supply system 550 using the collection data. The predetermined number of times is, for example, several tens to one hundred and several tens. That is, the abnormality diagnosis system 600 diagnoses an abnormality of the fuel supply system 550 of the vehicle 500 whenever the number of trips of the vehicle 500 reaches several tens to one hundred and several tens.

Specifically, when diagnosis data which is not yet reflected in the diagnosis process is received the predetermined number of times, the server device 300 forms the first collection data and the second collection data into input data. Then, the server device 300 inputs the formed input data to a trained model generated through machine learning and performs the diagnosis process of the fuel supply system 550 using the trained model.

As illustrated in FIG. 5, the trained model in the abnormality diagnosis system 600 is a decision tree and is stored in the storage device 302 in advance. The trained model is a model which is trained by machine learning using training data in which a correct answer label is given to input data which has been converted to an occurrence ratio obtained by dividing the occurrence frequency stored in each area of the collection data by the total number of pieces of diagnosis data collected up to that time. The correct answer label is information indicating whether there is an abnormality associated with a decrease in feed pressure Pf and a type of a cause of the abnormality. Specifically, some labels including "normal" indicating that there is no abnormality, "impeller" indicating deterioration of the impeller 52*c*, "check valve" indicating the operation failure of the check valve 59, and "other" indicating an abnormality which is not affected by the fuel temperature Tf are given to the training data.

That is, the input data includes 32 numerical values including 16 numerical values indicating the ratio of the frequency in which the minimum fuel pressure was recorded in the 16 areas of the first collection data and 16 numerical values indicating the ratio of the frequency in which the minimum fuel pressure was recorded in the 16 areas of the second collection data. The training data includes 37 values including the 32 values and one value indicating one label of the four labels.

Generation of the trained model, that is, learning, is performed by inputting a data set which is a set of training data to a computer. The computer repeatedly performs search with a greedy method using a general algorithm which is used for learning of a decision tree and using the input data set and generates a decision tree such that a junction from which a larger amount of information is acquired is disposed at a higher position of a tree. The decision tree which is generated by performing learning in advance is stored as a trained model in the storage device 302 of the server device 300.

As illustrated in FIG. 5, the decision tree stored in the storage device 302 of the abnormality diagnosis system 600 includes nodes which branch depending on whether a numerical value included in the input data is greater than a threshold value and leaves indicating a diagnosis result.

In the decision tree, first, in node N100, the execution device 301 determines whether the value of "temp2d" in the input data is greater than a threshold value X1. When the value of "temp2d" in the input data is greater than the threshold value X1, the execution device 301 determines whether the value of "temp1c" in the input data is greater than a threshold value X2 in node N111. The threshold value X2 is a value less than the threshold value X1.

When it is determined in node N111 that the value of "temp1c" in the input data is greater than the threshold value X2, the execution device 301 diagnoses that an operation failure of the check valve 59 has occurred in leaf N123.

On the other hand, when it is determined in node N111 that the value of "temp1c" in the input data is equal to or less than the threshold value X2, the execution device 301 diagnoses that the fuel supply system 550 is normal in leaf N122.

When it is determined in node N100 that the value of "temp2d" in the input data is equal to or less than the threshold value X1, the execution device 301 determines whether the value of "time4c" in the input data is greater than a threshold value X3 in node N110. The threshold value X3 is a value less than the threshold value X2.

When it is determined in node N110 that the value of "time4c" in the input data is equal to or less than the threshold value X3, the execution device 301 diagnoses that an operation failure of the check valve 59 has occurred in leaf N120.

When it is determined in node N110 that the value of "time4c" in the input data is greater than the threshold value X3, the execution device 301 determines whether the value of "temp1b" in the input data is greater than a threshold value X4 in node N121. The threshold value X4 is a value less than the threshold value X3.

When it is determined in node N121 that the value of "temp1b" in the input data is greater than the threshold value X4, the execution device 301 determines that other abnormality which is not affected by the fuel temperature Tf has occurred in node N131.

When it is determined in node N121 that the value of "temp1b" in the input data is equal to or less than the threshold value X4, the execution device 301 diagnoses that deterioration of the impeller 52*c* has occurred in leaf N130.

In this way, in the abnormality diagnosis system 600, diagnosis data acquired by the control device 100 mounted in the vehicle 500 is transmitted to the server device 300 via the communication network 400. The server device 300 prepares input data using collection data obtained by collecting the diagnosis data, and diagnoses an abnormality of the fuel supply system 550 using a decision tree which is a trained model stored in the storage device 302. That is, in the abnormality diagnosis system 600, the control device 100 and the server device 300 which are connected to each other via the communication network 400 constitutes the abnormality diagnosis system 600.

Details of routines which are performed by the control device 100 and the server device 300 in the abnormality diagnosis system 600 to realize the aforementioned diagnosis of an abnormality will be described below with reference to FIGS. 6 to 8.

Figure 6:
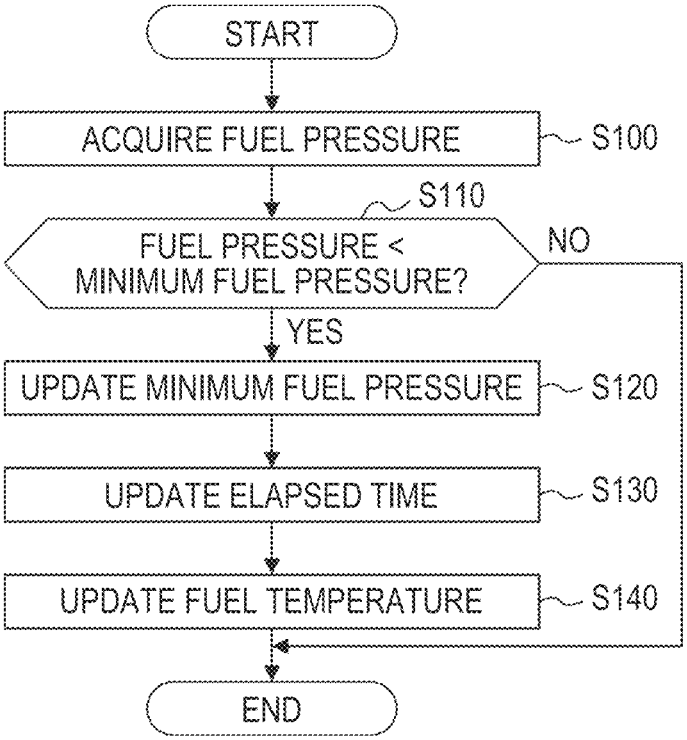
FIG. 6 is a flowchart illustrating a flow of a series of processes in a routine associated with acquisition of diagnosis data.

The routine illustrated in FIG. 6 is a routine associated with acquisition of diagnosis data which is performed by the execution device 101 of the control device 100 mounted in the vehicle 500. This routine is repeatedly performed by the execution device 101 while the fuel pump 52 is operating on the condition that a predetermined mask time has elapsed after the main switch 140 was turned on and the fuel pump 52 was started. The mask time is set to correspond to a time required for the feed pressure Pf to reach a predetermined level equal to or higher than 300 kPa in the fuel supply system 550 in a new-product state in which an abnormality has not occurred.

When the mask time elapses and this routine is started, the execution device 101 acquires a fuel pressure in the fuel pipe 57, that is, the feed pressure Pf, detected by the fuel pressure sensor 131. Then, in Step S110, the execution device 101 determines whether the feed pressure Pf which is the acquired fuel pressure is less than a minimum fuel pressure which is the lowest pressure out of the feed pressures Pf acquired in the same trip. As will be described later, the minimum fuel pressure is stored in the storage device 102. When the main switch 140 is turned on and the process of Step S110 is performed for the first time, the minimum fuel pressure is not recorded in the storage device 102 and thus the determination result of the process of Step S110 is positive.

When it is determined in the process of Step S110 that the feed pressure Pf is less than the minimum fuel pressure (Step S110: YES), the execution device 101 causes the routine to proceed to Step S120. Then, the execution device 101 updates the value of the minimum fuel pressure in the process of Step S120. That is, the execution device 101 stores the value of the newest feed pressure Pf acquired through the process of Step S100 as a new minimum fuel pressure in the storage device 102.

When the minimum fuel pressure is stored in this way, the execution device 101 updates the elapsed time after the fuel pump 52 was started in the process of Step S130. That is, the execution device 101 stores the elapsed time at that time as a new elapsed time in the storage device 102.

Then, the execution device 101 causes the routine to proceed to Step S130 and updates the fuel temperature Tf which is recorded as the diagnosis data. That is, the execution device 101 stores the fuel temperature Tf at that time as a new fuel temperature Tf in the storage device 102. When the minimum fuel pressure, the elapsed time when the minimum fuel pressure was recorded, and the fuel temperature Tf when the minimum fuel pressure was recorded are stored as the diagnosis data in the storage device 102 in this way, the execution device 101 temporarily ends this routine.

On the other hand, when it is determined in the process of Step S110 that the feed pressure Pf is equal to or greater than the minimum fuel pressure (Step S110: NO), the execution device 101 does not perform the processes of Steps S120 to S140 and temporarily ends this routine.

In this way, the control device 100 stores the minimum fuel pressure in one trip and the elapsed time and the fuel temperature Tf when the minimum fuel pressure was recorded as the diagnosis data in the storage device 102 by causing the execution device 101 to repeatedly perform the routine. Then, in the control device 100, when the main switch 140 is turned off and the trip ends, the execution device 101 causes the transmitter 103 to transmit the diagnosis data stored in the storage device 102.

Figure 7:
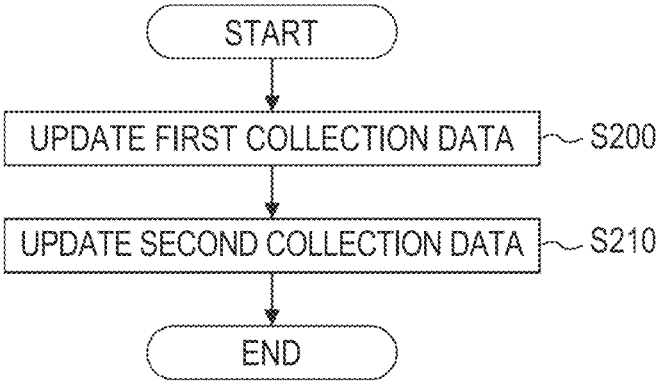
FIG. 7 is a flowchart illustrating a flow of a series of processes in a routine associated with update of collection data.
Figure 8:
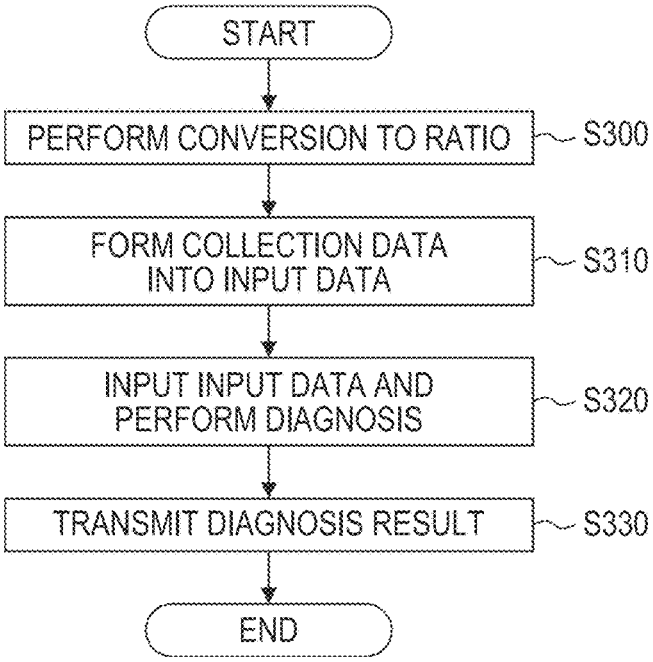
FIG. 8 is a flowchart illustrating a flow of a series of processes in a routine associated with a diagnosis process.

When the diagnosis data transmitted from the transmitter 103 of the control device 100 in this way is received, the execution device 301 of the server device 300 performs the routine illustrated in FIG. 7. When this routine is started, the execution device 301 first updates the first collection data stored in the storage device 302 in the process of Step S200. As described above with reference to FIG. 3, the first collection data is data obtained by collecting the frequency in which the minimum fuel pressure was recorded according to combinations of the minimum fuel pressure and the fuel temperature Tf. In the process of Step S200, the execution device 301 increments the frequency in a corresponding area in the first collection data by "1" based on the received diagnosis data.

For example, when the value of the minimum fuel pressure in the received diagnosis data is 240 kPa, the elapsed time is 15 seconds, and the fuel temperature Tf is 35° C., the execution device 301 increments the frequency in "temp2c" of the first collection data by "1" in the process of Step S200 to update the first collection data.

Then, the execution device 301 causes the routine to proceed to Step S210, and updates the second collection data stored in the storage device 302 in the process of Step S210. As described above with reference to FIG. 4, the second collection data is data obtained by collecting the frequency in which the minimum fuel pressure was recorded according to combinations of the minimum fuel pressure and the elapsed time when the minimum fuel pressure wasn recorded. In the process of Step S210, the execution device 301 increments the frequency in the corresponding area of the second collection data by "1" based on the received diagnosis data.

For example, when the value of the minimum fuel pressure in the received diagnosis data is 240 kPa, the elapsed time is 15 seconds, and the fuel temperature Tf is 35° C., the execution device 301 increments the frequency in "time2c" of the first collection data by "1" in the process of Step S210 to update the second collection data. When the second collection data is updated in this way, the execution device 301 ends this routine. The server device 300 updates the collection data in this way whenever diagnosis data is received.

A routine associated with a diagnosis process which is performed by the server device 300 will be described below with reference to FIG. 8. As described above, the server device 300 performs the diagnosis process whenever the diagnosis data for the fuel supply system 550 to be diagnosed is received a predetermined number of times.

Specifically, when the diagnosis data is received a predetermined number of times, the execution device 301 of the server device 300 performs this routine and performs the diagnosis process. When this routine is started, the execution device 301 first converts the values of the frequencies in the first collection data and the second collection data to ratios in the process of Step S300. That is, the execution device 301 prepares collection data obtained by converting an occurrence frequency of the minimum fuel pressure stored in each area of the collection data stored in the storage device 302 to an occurrence ratio obtained by dividing the occurrence frequency by the total number of pieces of diagnosis data collected up to now. For example, when the predetermined number of times is 100 and the total number of pieces of diagnosis data collected when the routine is being performed is 200, the first collection data and the second collection data corresponding to the occurrence frequency of 200 are stored. In this case, the execution device 301 calculates the occurrence ratio which is a share of division of the occurrence frequency stored in each area by "200" and prepares collection data in which the occurrence ratio in each area is stored.

When the occurrence frequency in the collection data is converted to a ratio in this way, the execution device 301 causes the routine to proceed to Step S310, and the execution device 301 forms the collection data including the ratios into input data in the process of Step S310. The input data is data which is input to the trained model stored in the storage device 302 described above with reference to FIG. 5.

In the process of Step S310, the execution device 301 forms a set of 32 numerical values including values of the areas of the first collection data and the second collection data which have been converted to the ratios into one piece of input data.

Then, the execution device 301 causes the routine to proceed to Step S320, and the execution device 301 performs the diagnosis process by inputting the formed input data to the trained model stored in the storage device 302. In the process of Step S330, the execution device 301 transmits the diagnosis result of diagnosis using the trained model to the vehicle 500 in which the fuel supply system 550 to be diagnosed is mounted via the transmitter 303. When the diagnosis result is transmitted in this way, the execution device 301 ends this routine.

In this way, in the abnormality diagnosis system 600, the control device 100 mounted in the vehicle 500 includes the storage device 102 that stores diagnosis data and the transmitter 103 that transmits the diagnosis data, and serves as a data transmitting device. The server device 300 includes the execution device 301 that performs the diagnosis process, the storage device 302 that stores the trained model, and the receiver 304 that receives the diagnosis data, and serves as an abnormality diagnosis device.

When the diagnosis result is received by the receiver 104, the execution device 101 of the control device 100 operates the display unit 150 based on the diagnosis result. When the received diagnosis result indicates that deterioration of the impeller has occurred, the execution device 101 causes the display unit 150 to display information indicating that an abnormality has occurred in the fuel pump 52. On the other hand, when the received diagnosis result indicates that an operation failure of the check valve 59 has occurred, the execution device 101 causes the display unit 150 to display information indicating that an abnormality has occurred in the check valve 59. When the received diagnosis result indicates the other abnormality, the execution device 101 causes the display unit 150 to display information indicating that an abnormality has occurred in the fuel supply system. When the diagnosis result indicates normality, the execution device 101 does not particularly operate the display unit 150.

Operations of this embodiment will be described below. When a fuel pressure in the fuel pipe 57 decreases while the fuel pump 52 is operating, there is a likelihood that an abnormality will have occurred in the fuel supply system 550. In the abnormality diagnosis system 600 according to the embodiment, diagnosis of an abnormality is performed based on a minimum fuel pressure and data indicating a state when the minimum fuel pressure was recorded instead of diagnosing whether an abnormality has occurred under specific conditions. Accordingly, it is possible to detect various abnormalities due to different causes.

The data indicating the state when the minimum fuel pressure was recorded is data indicating a state when an abnormality has been estimated to occur. Accordingly, when diagnosis data including the data indicating the state when the minimum fuel pressure was recorded is used, it is possible to estimate why the fuel pressure in the fuel pipe 57 has become the minimum fuel pressure.

Advantages of this embodiment will be described below.

(1) According to the aforementioned embodiment in which an abnormality of the fuel supply system 550 is diagnosed using diagnosis data, it is possible to determine a failure spot associated with a decrease in fuel pressure in the fuel pipe 57 as well as to diagnose whether an abnormality has occurred.

(2) The diagnosis data includes the elapsed time after the fuel pump 52 was started as data indicating the state when a minimum fuel pressure was recorded. The elapsed time after the fuel pump 52 was started and until the minimum fuel pressure has been recorded is data indicating a relationship between the time as which the fuel pump 52 was started and the time at which the decrease in fuel pressure has occurred. According to the aforementioned embodiment, it is possible to determine a failure spot associated with the decrease in fuel pressure in the fuel pipe 57 with reference to whether the decrease in fuel pressure has occurred immediately after the fuel pump 52 was started or after a while from the time at which the fuel pump 52 was started.

(3) The check valve 59 is opened when the fuel pump 52 is operating, fuel is being discharged from the fuel pump 52, and a flow of fuel from the fuel pump 52 to the cylinder fuel injection valve 44 and the port fuel injection valve 30 is in the fuel pipe 57. When the check valve 59 is not appropriately opened due to an operation failure of the check valve 59, a decrease in fuel pressure is likely to occur immediately after the fuel pump 52 was started. On the other hand, when the impeller 52*c* of the fuel pump 52 has deteriorated, the impeller 52*c* is deformed while the fuel pump 52 is operating, and the impeller 52*c* is less likely to rotate due to interference with the housing 52*b*. As a result, the decrease in fuel pressure occurs. The decrease in fuel pressure due to deterioration of the impeller 52*c* is more likely to occur in a time period after a time period in which the decrease in fuel pressure due to the operation failure of the check valve 59 is likely to occur.

Accordingly, when a minimum fuel pressure has been recorded in a relatively long elapsed time after the fuel pump 52 was started, the deterioration of the impeller 52*c* is more likely to be a cause of the decrease in fuel pressure than the operation failure of the check valve 59.

Accordingly, when data indicating a relationship between the time at which the fuel pump 52 was started and the time at which the decrease in fuel pressure occurred is used as diagnosis data as in the aforementioned configuration, it is possible to determine the deterioration of the impeller 52*c* of the fuel pump 52 and the operation failure of the check valve 59 and to diagnose an abnormality of the fuel supply system 550.

(4) With the abnormality diagnosis system 600, since diagnosis is performed using collection data obtained by collecting the diagnosis data in a plurality of trips, it is possible to perform diagnosis with high accuracy in comparison with a case in which diagnosis is performed using only the diagnosis data in one trip.

(5) The fuel temperature Tf when the minimum fuel pressure has been recorded is data indicating a relationship between the fuel temperature Tf and the decrease in fuel pressure. When the fuel pressure decreases due to an abnormality occurring in the fuel supply system 550, a degree of influence of the fuel temperature on the decrease in fuel pressure varies depending on a failure spot. With the abnormality diagnosis system 600, it is possible to determine the failure spot associated with the decrease in fuel pressure in the fuel pipe 57 with reference to whether the decrease in fuel pressure has occurred when the fuel temperature is low or whether the decrease in fuel pressure has occurred when the fuel temperature is high.

(6) When the impeller 52*c* has deteriorated, the impeller 52*c* is likely to be deformed with an increase in the fuel temperature and the temperature of the impeller 52*c* and the fuel pressure is likely to decrease due to interference of the impeller 52*c* with the housing 52*b*. The check valve 59 is more likely to cause an operation failure as the fuel temperature decreases. Accordingly, by performing diagnosis using the collection data obtained by collecting the diagnosis data including the data of the fuel temperature when the minimum fuel pressure has been recorded as described above, it is possible to diagnose whether a decrease in fuel pressure is an abnormality of deterioration of the impeller 52*c* or the operation failure of the check valve 59 which is affected by the fuel temperature or another abnormality which is not affected by the fuel temperature.

(7) A model that diagnoses whether an abnormality has occurred based on the collection data and outputs a type of a cause of an abnormality when the abnormality has occurred can be prepared by machine learning. By using machine learning, it is possible to extract a feature of which a person is not likely to be aware and to perform diagnosis of an abnormality. As in the abnormality diagnosis system 600, in comparison with a case in which a trained model with a plurality of pieces of diagnosis data as an input is constructed, it is possible to decrease an amount of input data using a trained model with the collection data of the diagnosis data as an input.

(8) In comparison with a model such as a neural network, a person can more easily understand grounds for diagnosis using the trained model using the decision tree. With the abnormality diagnosis system 600, it is possible to construct an abnormality diagnosis system 600 that can easily explain grounds for a result of diagnosis.

(9) In the abnormality diagnosis system 600, the storage device 102 that is mounted in a vehicle 500 and stores diagnosis data and the storage device 302 that is mounted in the server device 300 which is different from the vehicle 500 and stores a trained model are provided as storage devices. That is, the abnormality diagnosis system 600 includes the storage device 102 serving as a first storage device mounted in a vehicle 500 and the storage device 302 serving as a second storage device mounted in the server device 300.

The execution device 301 which is mounted in the server device 300 along with the storage device 302 receives diagnosis data stored in the storage device 102 from the vehicle 500 and prepares collection data. The execution device 301 determines a cause of an abnormality associated with a decrease in fuel pressure in the fuel pipe 57 using the trained model stored in the storage device 302 using the prepared collection data to diagnose an abnormality of the fuel supply system 550.

With this configuration, preparation of collection data, diagnosis of an abnormality using a trained model, and the like are performed by the server device 300 which is different from the vehicle 500. Accordingly, it is possible to curb an increase in capacity of the storage device 302 on the vehicle 500 side or an increase in a calculational load on the vehicle 500 side.

This embodiment can be modified as follows. The embodiment and the following modified examples can be combined unless technical confliction arises.

In the abnormality diagnosis system 600, the trained model is a decision tree, but the trained model which is used for the diagnosis process may not be necessarily a decision tree. For example, the trained model which is used for the diagnosis process may be a random forest that determines a result of a diagnosis by majority of a plurality of decision trees. The trained model which is used for the diagnosis process may be a neural network illustrated in FIG. 9.

Figure 9:
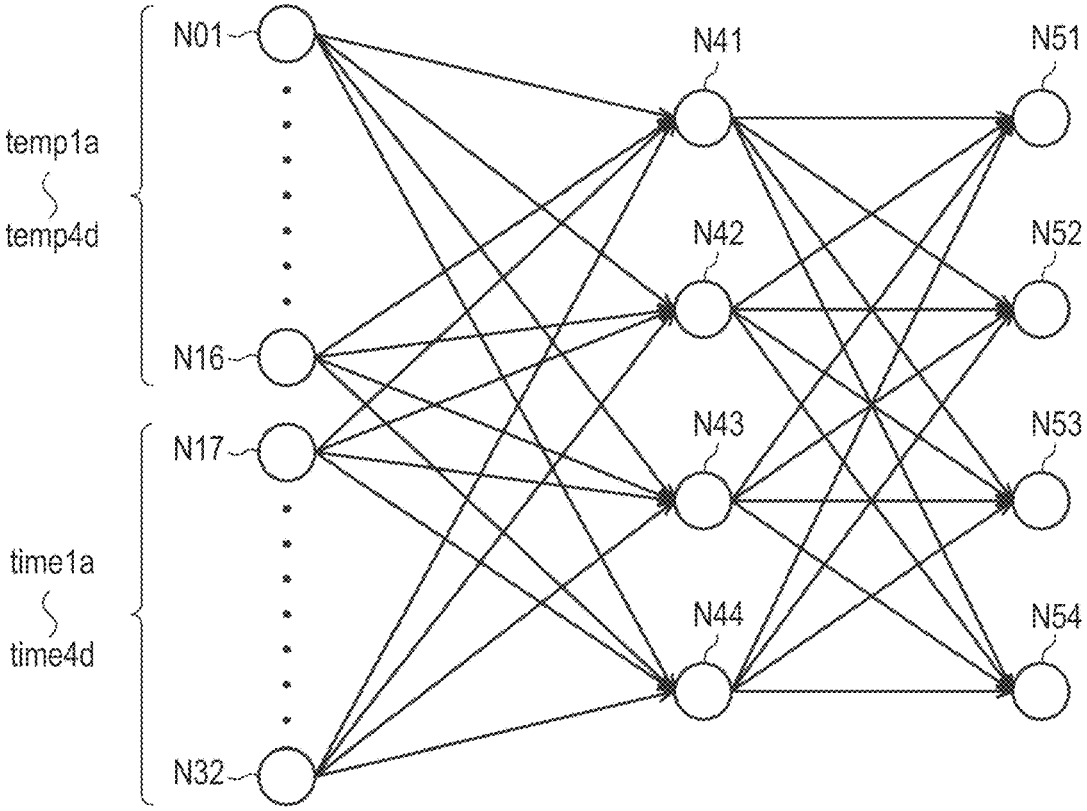
FIG. 9 is a diagram illustrating a neural network which is used for a diagnosis process in an abnormality diagnosis system according to a modified example.

In the example illustrated in FIG. 9, the neural network includes an input layer including 32 nodes (nodes N01 to N32) to which a value obtained by converting the occurrence frequency in each area of the first collection data to a ratio and a value obtained by converting the occurrence frequency in the corresponding area of the second collection data to a ratio are input. This neural network includes an intermediate layer including four nodes (nodes N41 to N44) and an output layer including four nodes (nodes NM to NM).

In the neural network illustrated in FIG. 9, an activation function of the intermediate layer is a sigmoid function. An input to the intermediate layer is calculated as a sum of values obtained by multiplying the 32 input values to the input layer by weights. Sums of values obtained by multiplying the output values of the nodes (nodes N41 to N44) of the intermediate layer by weights are input to the output layer. The input values to the output layer are input to an output layer which is a softmax layer and is converted to output values corresponding to the nodes (NM to NM). The sum of the output values of the nodes (nodes NM to NM) of the output layer is "1" and the output values represent proportions with respect to "1." The nodes (nodes NM to NM) of the output layer correspond to the results of diagnosis output through the diagnosis process. The type of the result of diagnosis is the same as in the aforementioned embodiment. For example, node N51 corresponds to "normal," and node N52 corresponds to "deterioration of the impeller." Node N53 corresponds to an "operation failure of the check valve 59," and node N54 corresponds to "other abnormality." That is, the output layer outputs probabilities corresponding to four results of diagnosis including "normal," "deterioration of impeller," "operation failure of the check valve 59," and "other abnormality."

When supervised learning is performed by inputting training data as in the aforementioned embodiment to the neural network, a trained model that can diagnose an abnormality of the fuel supply system 550 can be generated similarly to the aforementioned embodiment using the inputs described in the aforementioned embodiment.

The neural network illustrated in FIG. 9 includes only a single intermediate layer, but the number of intermediate layers may be set to an arbitrary number equal to or greater than 2 and the number of nodes of the intermediate layer may be set to an arbitrary number.

In the aforementioned embodiment, diagnosis of an abnormality is performed using the trained model which has been trained by machine learning, but the trained model which has been trained by machine learning may not be used. For example, it may be considered that threshold values of junctions are found by repeating experiment and verification and a model such as the decision model described in the aforementioned embodiment is constructed.

In the aforementioned embodiment, one diagnosis of an abnormality is performed based on the collection data obtained by collecting data of a predetermined number of trips, but diagnosis of an abnormality may be performed every trip based on a minimum fuel pressure and information when the minimum fuel pressure has been recorded.

The fuel temperature Tf when the minimum fuel pressure has been recorded is included in the diagnosis data, but a configuration in which diagnosis of an abnormality is performed without including the fuel temperature Tf in the diagnosis data may be employed.

Figure 10:
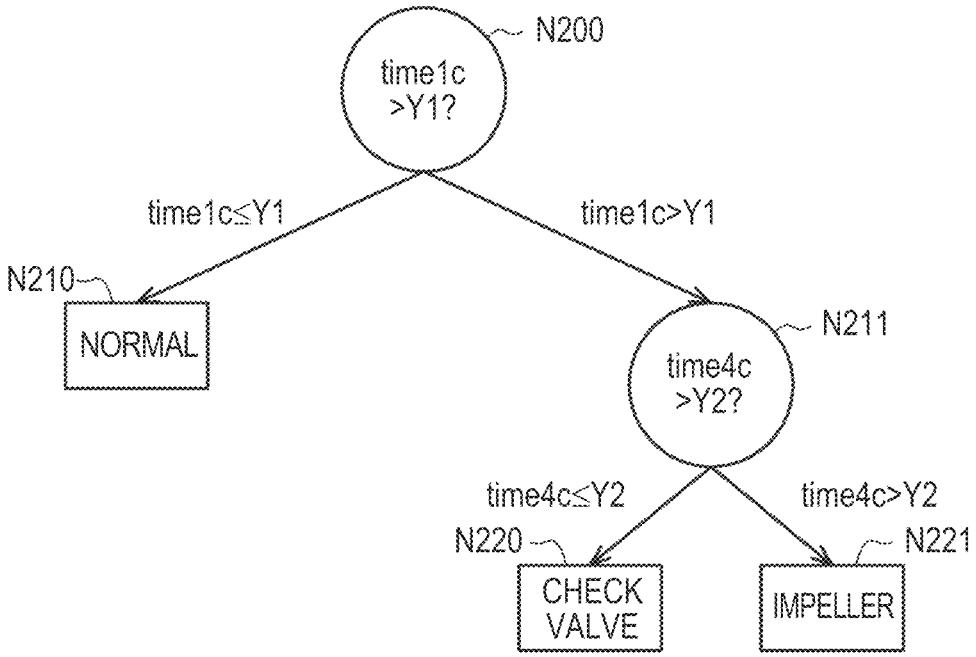
FIG. 10 is a diagram illustrating a decision tree which is used for a diagnosis process in an abnormality diagnosis system according to another modified example.

For example, a decision tree illustrated in FIG. 10 is an example of a decision tree that performs a diagnosis process based on only the second collection data. This decision tree can be generated by performing supervised learning using the second collection data and training data including 17 values of correct answer labels. Since information on the fuel temperature Tf is not included in the second collection data, an influence of the fuel temperature Tf is not considered in this decision tree. Accordingly, an output corresponding to "other abnormality" in the aforementioned embodiment is not included in the output of the decision tree. That is, the labels in the training data include three types of "normal," "impeller," and "check valve," and the results of diagnosis output from the decision tree include three types of "normal," "deterioration of the impeller," and "operation failure of the check valve."

As illustrated in FIG. 10, in this decision tree, first, the execution device 301 determines whether "time1c" in the input data is greater than a threshold value Y1 in node N200. When "time1c" in the input data is equal to or less than the threshold value Y1, the execution device 301 determines that it is normal in leaf N210.

On the other hand, when "time1c" in the input data is greater than the threshold value Y1, the routine proceeds to node N211 and the execution device 301 determines whether "time4c" in the input data is greater than a threshold value Y2. The threshold value Y2 is a value less than the threshold value Y1.

When "time4c" in the input data is greater than the threshold value Y2, the routine proceeds to N221 and the execution device 301 determines that deterioration of the impeller 52*c* has occurred. On the other hand, when "time4c" in the input data is equal to or less than the threshold value Y2, the execution device 301 determines that the operation failure of the check valve 59 has occurred in leaf N220.

Details of the diagnosis data are not limited to the aforementioned examples. For example, diagnosis data not including information on the elapsed time when the minimum fuel pressure has been recorded may be used. The information indicating the state when the minimum fuel pressure was recorded which is included in the diagnosis data may not be the fuel temperature Tf or the elapsed time.

The control device 100 which is a data transmitting device may perform collection of diagnosis data and the control device 100 may transmit collection data to the server device 300 via the transmitter 103. In this case, the server device 300 can prepare input data from the received collection data and perform the diagnosis process.

The abnormality diagnosis system may include only the control device 100 mounted in the vehicle 500. That is, a trained model may be stored in the storage device 102 and the control device 100 may perform acquisition and collection of diagnosis data, preparation of input data, and a diagnosis process. Similarly to the aforementioned embodiment, the diagnosis data is transmitted from the control device 100, but the server device 300 may merely prepare collection data, collection data may be transmitted from the server device 300 to the control device 100, and the control device 100 may perform the diagnosis process.

The control device 100 controls the fuel pump 52 via the fuel pump control device 200, but a configuration in which a single control device has the functions of both the control device 100 and the fuel pump control device 200 may be employed. The control device for the fuel supply system 550 may be constituted by three or more units.

In the aforementioned embodiments, it is notified that an abnormality has occurred using visual information by operating the display unit 150, but the applicable embodiment is not limited thereto. For example, it may be notified that an abnormality has occurred using auditory information by operating a speaker.

The execution device 101 or the execution device 301 is not limited to an execution device that performs software processes. For example, a dedicated hardware circuit (for example, an ASIC) that performs at least a part of the software processes performed in the aforementioned embodiments in hardware may be provided. That is, the execution device 101 or the execution device 301 may have at least one of the following configurations (a) to (c). (a) A processor that performs all the processes in accordance with a program and a program storage device such as a ROM that stores the program are provided. (b) A processor that performs some of the processes in accordance with a program, a program storage device, and a dedicated hardware circuit that performs the other processes are provided. (c) A dedicated hardware circuit that performs all the processes is provided. Here, the number of software processing circuits including a processor and a program storage device or the number of dedicated hardware circuits may be two or more.

In the aforementioned embodiments, the fuel supply system 550 including the cylinder fuel injection valves 44 and the port fuel injection valves 30 as fuel injection valves are exemplified above, but the fuel supply system is not limited to such a configuration. For example, the fuel supply system may include only the port fuel injection valves. For example, the fuel supply system may include only the cylinder fuel injection valves.

The vehicle 500 is not limited to a vehicle in which a device generating a thrust of the vehicle is only an engine, and may be, for example, a series hybrid vehicle. The vehicle may be a parallel hybrid vehicle or a series/parallel hybrid vehicle as well as the series hybrid vehicle.

The fuel temperature Tf is detected by the fuel temperature sensor 137, but the fuel temperature Tf may be acquired by estimation.

What is claimed is:

1. An abnormality diagnosis system for a fuel supply system, the fuel supply system including a fuel pump configured to pump fuel from a fuel tank and a fuel pipe configured to discharge fuel from the fuel pump, the abnormality diagnosis system comprising:

a storage device; and an execution device, wherein the storage device stores a minimum fuel pressure in the fuel pipe in one trip after a main switch of the fuel supply system is turned on and until the main switch is turned off, and data indicating a state when the minimum fuel pressure was recorded as diagnosis data, wherein the execution device is configured to determine a failure spot associated with a decrease in fuel pressure in the fuel pipe using the diagnosis data, and diagnose an abnormality of the fuel supply system, wherein the storage device further stores a trained model which is trained by machine learning using training data in which information indicating (i) whether an abnormality associated with the decrease in fuel pressure in the fuel pipe has occurred and (ii) a type of a cause of the abnormality is given as a correction answer label to collection data, wherein the execution device is configured to determine a cause of an abnormality associated with the decrease in fuel pressure in the fuel pipe using the trained model with the collection data as an input and diagnose the abnormality of the fuel supply system, and wherein the collection data as the input to the trained model includes input data which has been converted to an occurrence ratio obtained by dividing an occurrence frequency of the minimum fuel pressure stored in each area of the collection data by the total number of pieces of the diagnosis data collected up to that time.

2. The abnormality diagnosis system according to claim 1, wherein the diagnosis data includes an elapsed time from starting of the fuel pump as the data indicating the state when the minimum fuel pressure was recorded.

3. The abnormality diagnosis system according to claim 2, wherein the execution device is configured to determine deterioration of an impeller of the fuel pump and an operation failure of a check valve, which is provided in the fuel pipe and which is opened by a flow of fuel discharged from the fuel pump and is closed when the fuel pump stops and supply of fuel stops, as the cause of the abnormality associated with the decrease in fuel pressure in the fuel pipe, and diagnose the abnormality of the fuel supply system.

4. The abnormality diagnosis system according to claim 2, wherein the execution device is configured to determine the cause of the abnormality associated with the decrease in fuel pressure in the fuel pipe using the collection data which is acquired by counting the occurrence frequency of the minimum fuel pressure for each combination of areas into which various types of data included in the diagnosis data are classified based on magnitudes of values of the data, and diagnose the abnormality of the fuel supply system.

5. The abnormality diagnosis system according to claim 4, wherein the diagnosis data includes a fuel temperature as the data indicating the state when the minimum fuel pressure was recorded.

6. The abnormality diagnosis system for a fuel supply system according to claim 5, wherein the execution device is configured to determine deterioration of an impeller of the fuel pump, an operation failure of a check valve, which is provided in the fuel pipe and which is opened by a flow of fuel discharged from the fuel pump and is closed when the fuel pump stops and supply of fuel stops, and other abnormalities which are not affected by the fuel temperature as the cause of the abnormality associated with the decrease in fuel pressure in the fuel pipe, and diagnose the abnormality of the fuel supply system.

7. The abnormality diagnosis system according to claim 1, wherein the trained model is a decision tree.

8. The abnormality diagnosis system according to claim 1, wherein the storage device includes a first storage device that is mounted in a vehicle and stores the diagnosis data and a second storage device that is mounted in a device outside the vehicle and stores the trained model, and wherein the execution device is mounted in the device outside the vehicle along with the second storage device, wherein the execution device is configured to receive the diagnosis data stored in the first storage device from the vehicle, prepare the collection data, determine the cause of the abnormality associated with the decrease in fuel pressure in the fuel pipe using the trained model stored in the second storage device with the prepared collection data as the input, and diagnose the abnormality of the fuel supply system.

9. A data transmitting device that is a constituent of the abnormality diagnosis system according to claim 8, the data transmitting device being mounted in the vehicle, the data transmitting device comprising:

the first storage device; and a transmitter configured to transmit the diagnosis data from the vehicle to the execution device.

10. An abnormality diagnosis device that is a constituent of the abnormality diagnosis system according to claim 8, the abnormality diagnosis device being mounted in the device outside the vehicle, the abnormality diagnosis device comprising:

the execution device;

the second storage device; and a receiver configured to receive the diagnosis data from the vehicle.

* * * * *